US008191334B2

(12) United States Patent
Braun

(10) Patent No.: US 8,191,334 B2
(45) Date of Patent: Jun. 5, 2012

(54) METHOD FOR LAYING FLOOR PANELS

(75) Inventor: Roger Braun, Willisau (CH)

(73) Assignee: Flooring Technologies Ltd., Pieta (MT)

( * ) Notice: Subject to any disclaimer, the term of this patent is extended or adjusted under 35 U.S.C. 154(b) by 0 days.

(21) Appl. No.: 12/865,625

(22) PCT Filed: Jun. 24, 2009

(86) PCT No.: PCT/EP2009/004550

§ 371 (c)(1),
(2), (4) Date: Oct. 8, 2010

(87) PCT Pub. No.: WO2010/006684

PCT Pub. Date: Jan. 21, 2010

(65) Prior Publication Data

US 2011/0016822 A1 Jan. 27, 2011

(30) Foreign Application Priority Data

Jul. 3, 2008 (DE) ..... 10 2008 031 167

(51) Int. Cl.
*E04B 2/00* (2006.01)

(52) U.S. Cl. ..... 52/747.11; 52/592.1; 52/588.1

(58) Field of Classification Search ..... 52/592.1, 52/588.1, 747.1, 747.11
See application file for complete search history.

(56) References Cited

U.S. PATENT DOCUMENTS 6,591,568 B1 * 7/2003 Pålsson ..... 52/592.2
6,862,857 B2 * 3/2005 Tychsen ..... 52/582.1
7,398,625 B2 * 7/2008 Pervan ..... 52/578
7,584,583 B2 * 9/2009 Bergelin et al. ..... 52/588.1
7,617,651 B2 * 11/2009 Grafenauer ..... 52/592.1
7,721,503 B2 * 5/2010 Pervan et al. ..... 52/586.1
7,980,041 B2 * 7/2011 Pervan et al. ..... 52/586.2
2008/0010931 A1 * 1/2008 Pervan et al. ..... 52/403.1
2008/0134613 A1 * 6/2008 Pervan ..... 52/582.2
2008/0241440 A1 10/2008 Bauer
2008/0295432 A1 * 12/2008 Pervan et al. ..... 52/395

(Continued)

FOREIGN PATENT DOCUMENTS

DE 102 24 540 12/2003

(Continued)

OTHER PUBLICATIONS

International Preliminary Report for corresponding International Application No. PCT/EP2009/004550, dated Jan. 27, 2011.

(Continued)

*Primary Examiner* — Robert Canfield
*Assistant Examiner* — Brent W Herring
(74) *Attorney, Agent, or Firm* — Andrew M. Calderon; Roberts Mlotkowski Safran & Cole, P.C.

(57) ABSTRACT

A method for laying floor panels in a room to form a closed floor area on a laying plane (R) without using an adhesive. The floor panels especially comprising a wood material, such as MDF or HDF, and having matching corresponding profiles on opposite longitudinal edges (I, I') and transverse edges (II, II'). The closed floor area is obtained by interconnecting a plurality of panels on their transverse edges (II, II') to give a row ($R_1$) and on their longitudinal edges (I,I') to give a plurality of rows (Rn) and then locking them in relation to each other.

19 Claims, 8 Drawing Sheets

U.S. PATENT DOCUMENTS

| | | | | |
|---|---|---|---|---|
| 2009/0173032 | A1* | 7/2009 | Prager et al. | 52/588.1 |
| 2010/0037550 | A1 | 2/2010 | Braun | |
| 2010/0043333 | A1 | 2/2010 | Hannig | |

FOREIGN PATENT DOCUMENTS

| | | |
|---|---|---|
| DE | 10 2006 057491 | 6/2008 |
| DE | 10 2007 015 048 | 10/2008 |
| DE | 10 2007 017 087 | 10/2008 |
| DE | 10 2007 042 840 | 3/2009 |
| EP | 1 350 904 | 10/2003 |
| EP | 1 980 683 | 10/2008 |
| WO | 2007/020088 | 2/2007 |
| WO | 2008/116623 | 10/2008 |

OTHER PUBLICATIONS

Written Opinion for corresponding International Application No. PCT/EP2009/004550, dated Jan. 27, 2011.

International Search Report for corresponding International Application PCT/EP2009/004550.

International Search Report for corressonding International Application PCT/EP2009/004550.

* cited by examiner

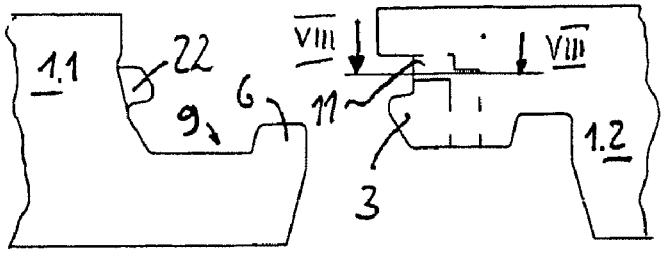
Fig. 5
Fig. 6
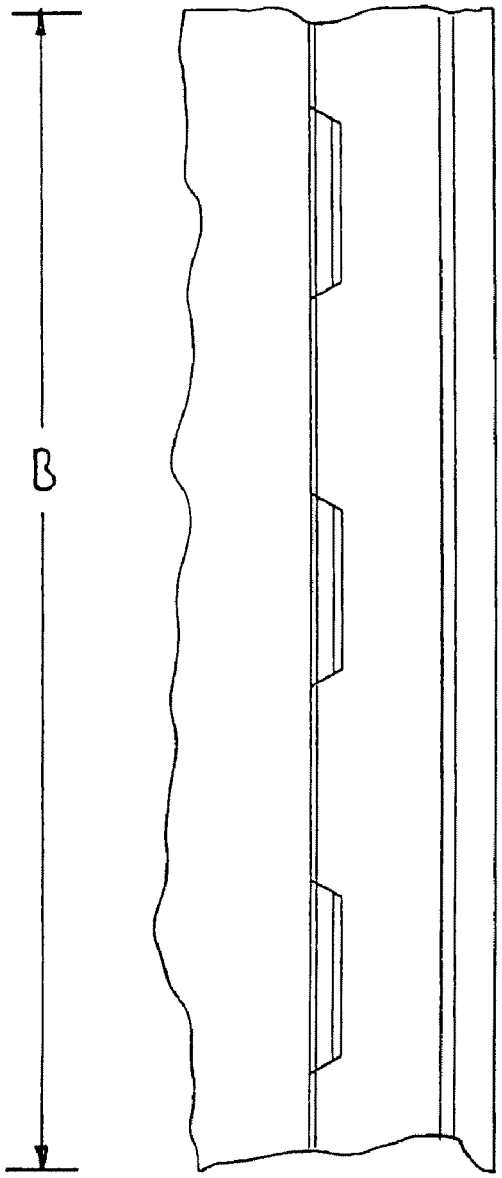
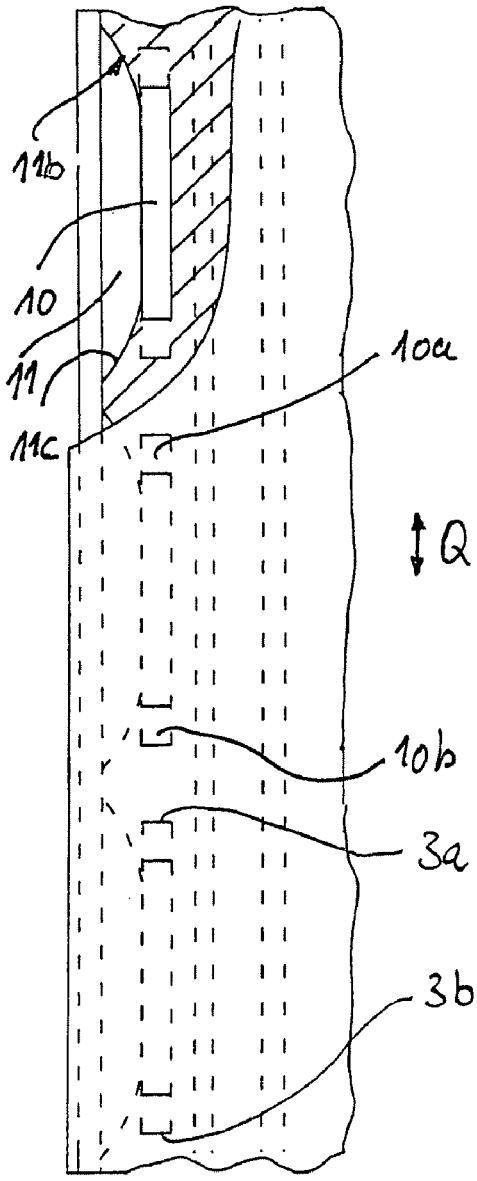
Fig. 7
Fig. 8

METHOD FOR LAYING FLOOR PANELS

BACKGROUND OF THE INVENTION

1. Field of the Invention

The invention relates to a method for laying of floor panels without adhesive, especially consisting of a wood material such as MDF or HDF, which on their opposite transverse edges and longitudinal edges are provided each with profiling which corresponds to one another, in a space for forming a closed floor surface on a laying plane in which several panels with their transverse edges are joined and locked to one another into a row $R_i$ and with their longitudinal edges into several rows $R_n$, in which:

a) to form the first row $R_1$:

- $a_1$) a first panel is put down in the laying plane and a second panel with its transverse edge is placed against the transverse edge of the first panel and by pivoting the second panel down or lowering it vertically into the laying plane the two panels are joined and locked to one another, and
- $a_2$) as many panels are joined and locked to one another in this way until the first row $R_1$ is completed, b) to form the second row $R_2$,

- $b_1$) another first panel with its longitudinal edge is placed against the longitudinal edge of at least one panel which has been put down in the first row $R_1$ and is joined and locked to this at least one panel by pivoting down into the laying plane,
- $b_2$) another second panel with its longitudinal edge is placed against the longitudinal edge of at least one panel which has been put down in the first row $R_1$ such that by its being pivoted down into the laying plane the longitudinal edge of the other panel is joined and locked to the longitudinal edge of at least one panel in the first row $R_1$ and its transverse edge is joined and locked to the transverse edge of the first panel in the second row $R_2$,
- $b_3$) as many panels are joined and locked to one another in this manner until the second row $R_2$ is completed, c) to form the third $R_3$ and each succeeding row $R_i$ steps $b_1$) to $b_3$) are repeated until the space has been completely put down, d) in the joining and locking of the transverse edges at least one locking element of one panel which consists of the core material of the panel and which is integrally joined to them snaps into contact with a locking edge of the other panel, and e) during locking by pivoting down or lowering into the laying plane a force acts in the vertical direction on the locking element of one panel and is converted at least partially into a force component which acts in the horizontal direction and first of all a yielding movement and afterwards a snapping movement of the locking element directed oppositely are effected.

2. Discussion of Background Information

This method is briefly described for example in DE 102 24 540 A1. To join the panels on the transverse sides the core material is first compressed and a projection which is provided in the tongue as a locking element then snaps behind the undercut which is acting in the groove of the opposite panel as a locking edge. So that the locking forces of two panels which are joined to one another are high enough, the projection or the entire tongue must be very strongly compressed during joining. Moreover, the profiling of the tongues with very close tolerances must ensure that the compression forces do not become too high; this could lead to destruction of the locking projection or the locking edge.

Laying must take place very carefully. If the panel which is to be laid is tilted so that the compression forces become too high at least in areas, there is the danger that destruction of the locking elements will take place only partially and will not be recognized from the outside because the joint of the two panels is closed in itself. After some time and especially as a result of fluctuations of temperature and humidity which lead to swelling and shrinking of the panels, the connection pulls apart; this can also become optically visible due to raised joining edges if only a quite small offset between the two panels occurs.

Based on this problem formulation, the initially described method will be improved such that laying is possible even with little care and destruction of the locking elements which remains unnoticed is largely precluded.

SUMMARY OF THE INVENTION

To solve this problem the generic method is characterized in that movement of the locking element both in the horizontal and also the vertical direction is ensured by the releasing of the locking element relative to the core of the panel.

Due to the ability of the locking element to move freely only small forces are necessary to have them yield during locking and then snap back. Even if the panels are tilted, the forces necessary for the lateral yielding motion do not rise, but the locking element reliably yields to each force acting on it and springs back when the force is no longer acting. The tongue element can be moved by the configuration as claimed in the invention in a horizontal plane and can move laterally into the space formed by the releasing.

Preferably to release the locking element from the core there are at least one essentially horizontal slot and at least one essentially vertical slot.

The width of the slots determines not only the strength of the linkage of the tongue element to the core material, but the choice of the width of the vertical slot can also form a stop in the horizontal direction for the tongue element so that it is reliably protected against overstretching. To expose the tongue element there can also be a plurality of horizontal slots in succession and one single vertical slot. Likewise there can be a single horizontal slot and a plurality of vertical slots in succession. It is also conceivable to provide both a plurality of horizontal and also a plurality of vertical slots in succession.

Preferably the tongue element with one of its ends is joined to the core.

If there is at least one slot proceeding from the bottom of the panel for release of the locking element, the horizontal slot can be eliminated since the locking element is free both toward the top and also the bottom.

The essentially vertical slot in this case runs preferably at least partially through a lower locking section.

BRIEF DESCRIPTION OF THE DRAWINGS

The method as claimed in the invention will be detailed below using the drawings.

FIG. 5 shows the side edge II' of the first panel;

FIG. 6 shows the side edge II of the second panel;

FIG. 7 shows a top view according to the section arrow VII in FIG. 5;

FIG. 8 shows a representation according to the section arrows VIII-VIII in FIG. 6;

DETAILED DESCRIPTION OF THE PRESENT INVENTION

Figure 1:
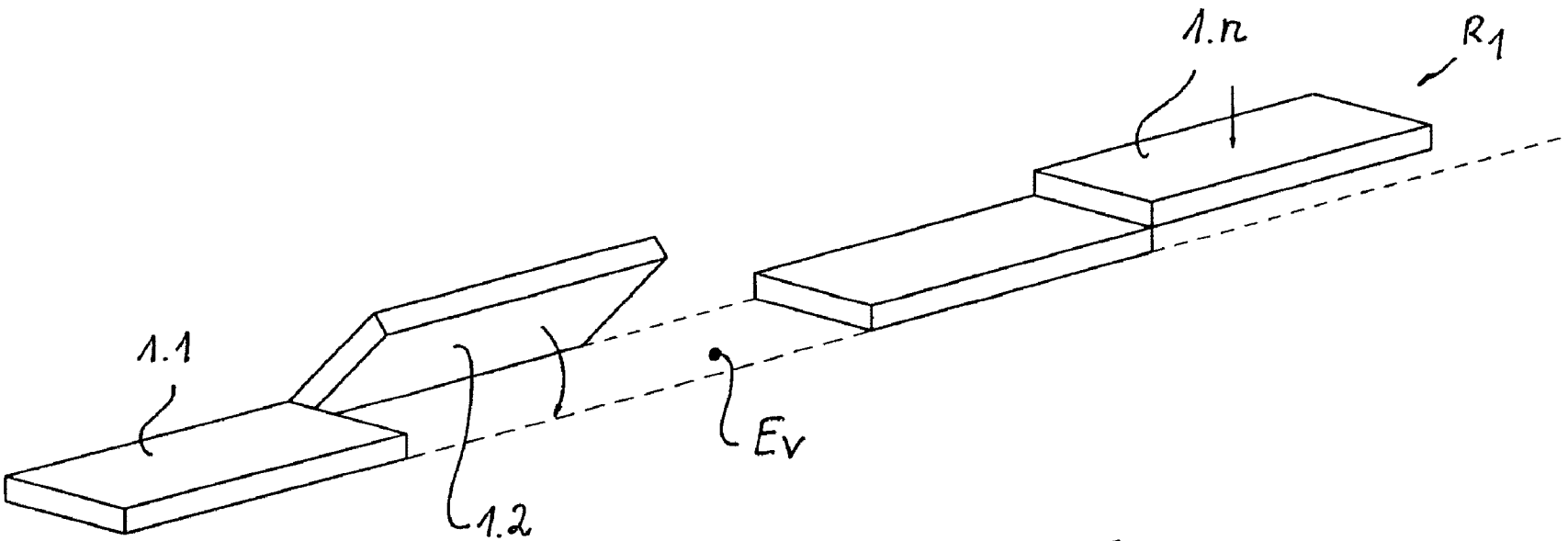
FIG. 1 shows a schematic of the first row $R_1$ of panels.

The panels 1.1, 1.2, . . . , **1.*n*, 2.1, 2.2, . . . are made identically. They consist of a core 17 of wood material such as HDF or MDF or a wood material-plastic mixture. On their opposing transverse edges II, II' the panels 1.1, 1.2, . . . , 1.*n*, 2.1, 2.2, . . . are profiled, the transverse edge II having to be worked by milling from the top 18 and the transverse edge from the bottom 19. On the transverse edge II' the tongue element 3 which has been produced by milling the core 17 free is made by a horizontal slot 11 and an essentially vertically running slot 10 having been milled in. The transverse edges II, II' have a width B. Exposure of the tongue element 3 from the core 17 takes place solely by the slots 10, 11. The outer edge 3*c* of the tongue element 3 is tilted by an angle α relative to the transverse edge to the top 18 of the panel 1, 2. The vertical surfaces of the transverse edges II, II' are worked such that contact surfaces 15, 16 form in the region of the top 18**.

Figure 4:
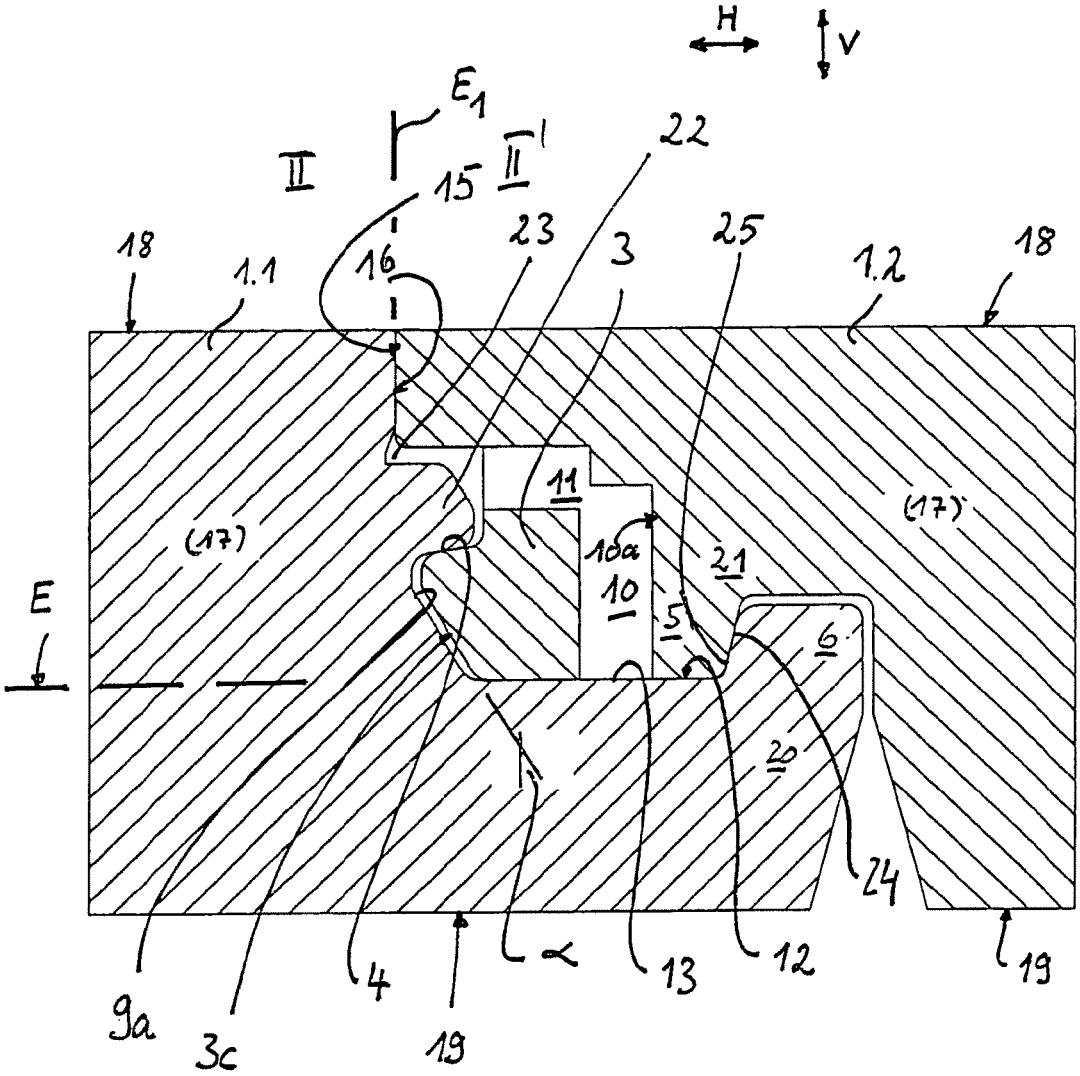
FIG. 4 shows a section through two panels at the joining site on the transverse edges.

On the side edge II opposite the tongue element 3 the panel 1.1, 1.2, . . . , **1.*n* is provided with a locking projection 22 which extends essentially in the horizontal direction H and whose lower side wall as an undercut forms an essentially horizontally running locking edge 4. The locking projection 22 projects laterally above the contact surface 16 of the panel 1. Underneath the locking projection 22 a, groove 9 is formed which holds one part of the tongue element 3 for locking of two panels 1.1, 1.2; 2.1, 2.2 in the vertical direction V. As is shown in FIG. 4, the groove base 9*a* of the groove 9 runs parallel to the outer edge 3*c* of the tongue element 3; this facilitates production of the groove 9, but it could also be made strictly in the vertical direction V or with an angle which deviates from the angle α. Relative to the length of the hook element 20 the locking projection 22 is short. Between the top of the locking projection 22 and the contact surface 16 on the side edge II of the panel 1.1 a dust pocket 23 is machined out of the material of the core 17**.

The two panels 1.1, 1.2; 2.1, 2.2 are locked in the horizontal direction H by way of hook elements 20, 21 which have been milled by step profiling and in the vertical direction V by way of the tongue element 3 in conjunction with the locking edge 4 on the locking projection 22. On the shoulder 5 of the hook element 21 which extends down, an at least partially plane head surface 12 is formed which interacts with a support surface 13 which is made on the hook element 20 on the opposite side edge II' and which projects back behind the projection 6. The head surface 12 and the support surface 13 end in the same horizontal plane E so that the panels 1.1, 1.2; 2.1, 2.2 which are joined to one another are supported on one another. The surface 24 of the hook element 21 facing the core 17 runs tilted relative to the vertical and together with the correspondingly tilted surface 25 facing the core 17 on the shoulder forms a locking edge of two joined panels 1, 2. The profiling of the hook elements 20, 21 is chosen such that at the joining site pretensioning is produced and the vertical contact surfaces 15, 16 of the panels 1.1, 1.2; 2.1, 2.2 are pressed against one another so that a visible gap does not form on the top 18 of two interconnected panels 1.1, 1.2, . . . , **1.*n*, 2.1, 2.2, . . . , 2.*n*. To facilitate joining of the panels 1.1, 1.2; 2.1, 2.2, the upwardly projecting shoulder 6 of the hook element 20 and the downwardly projecting shoulder 5 of the hook element 21 are edged or rounded on their edges. In order to facilitate production for forming the tongue element 3, either the horizontally running slot 11 or the essentially vertically running slot 10** can be continuous, therefore can extend over the entire width B of the transverse edge II'. With respect to other details of the locking element, reference is made to DE 10 2007 041 024.9.

Figure 11:
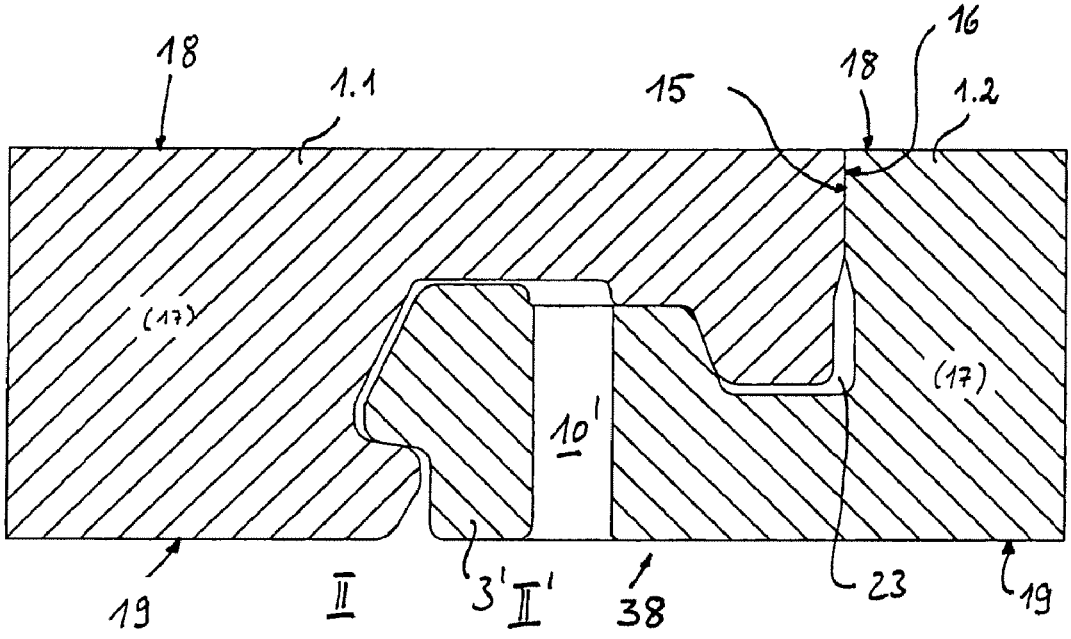
FIG. 11 shows a section through two panels of another embodiment at the joining site on the transverse edges.

As FIG. 11 shows, the locking element 3' can also be made on the bottom 19 of the panel 1.2. In this case the essentially vertical slot 10' runs at least partially through the lower locking section 38. Since the locking element 3' is released both toward the bottom 19 of the panel 1.2 and also toward its top 18, another horizontal slot is not necessary, so that edge profiling and production of the panels are simplified.

There is this above described manner of locking only on the transverse side of the panels which can be joined to one another on their longitudinal side I, I' by squaring and pivoting-down onto the underfloor, as is described in DE 102 24 540 A1 with the corresponding edge profiling.

Figure 9:
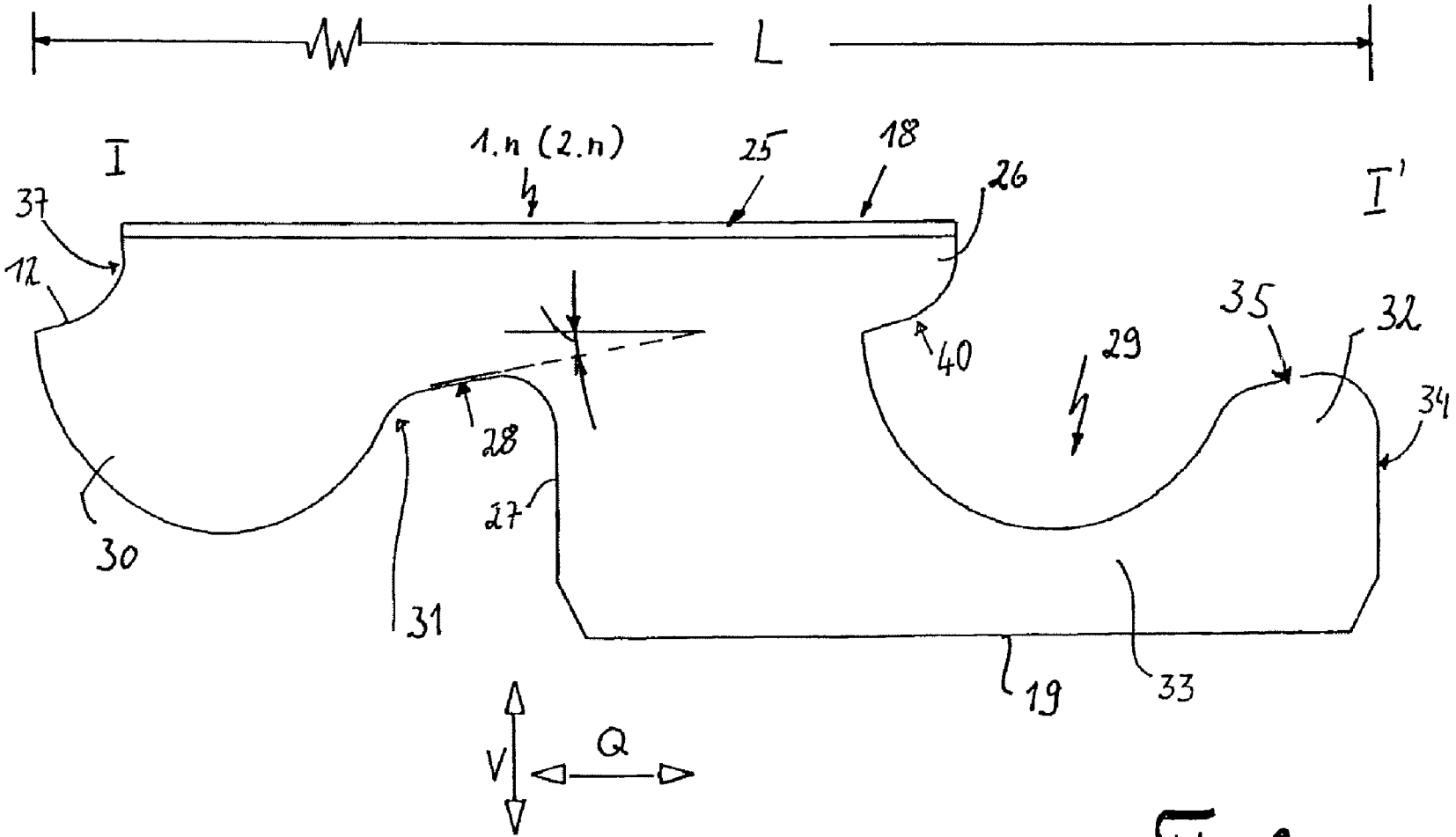
FIG. 9 shows a view of the longitudinal edge of a panel.

FIG. 9 shows a view of the longitudinal edge I, I' of a floor panel. On its top 18 the floor panel is provided with a decorative layer 25 which can be formed for example by a paper layer which has wood graining and which is coated with a synthetic resin layer which is used as wear protection. On the bottom 19, a noise insulation layer can be cemented to improve the impact sound properties of the installed floor panels **1.*n*, 2.*n*, . . . . Alternatively to the use of an HDF or MDF panel, the panel 1.*n*, 2.*n*, . . . can be produced from OSB (oriented strand board) material, and here a decorative layer 25 can be omitted. The panel 1.*n*, 2.*n* is recognizably provided with a tongue 30 and on the opposite second side edge with a recess 29**.

The recess 29 and the tongue 30 run over the entire length L of the longitudinal edges I, I'. On the tongue 30, there is a projection which is provided with a top, which projects to the outside, and which passes into a forward region which has an arc-shaped contour. The forward region of the tongue 30 which forms an undercut 31 is adjoined by a bearing region 28 which is made tilted at an angle μ to the top 8 of the panel **1.*n*. The bearing region 28 is adjoined by a vertically aligned wall 27**.

Figure 10:
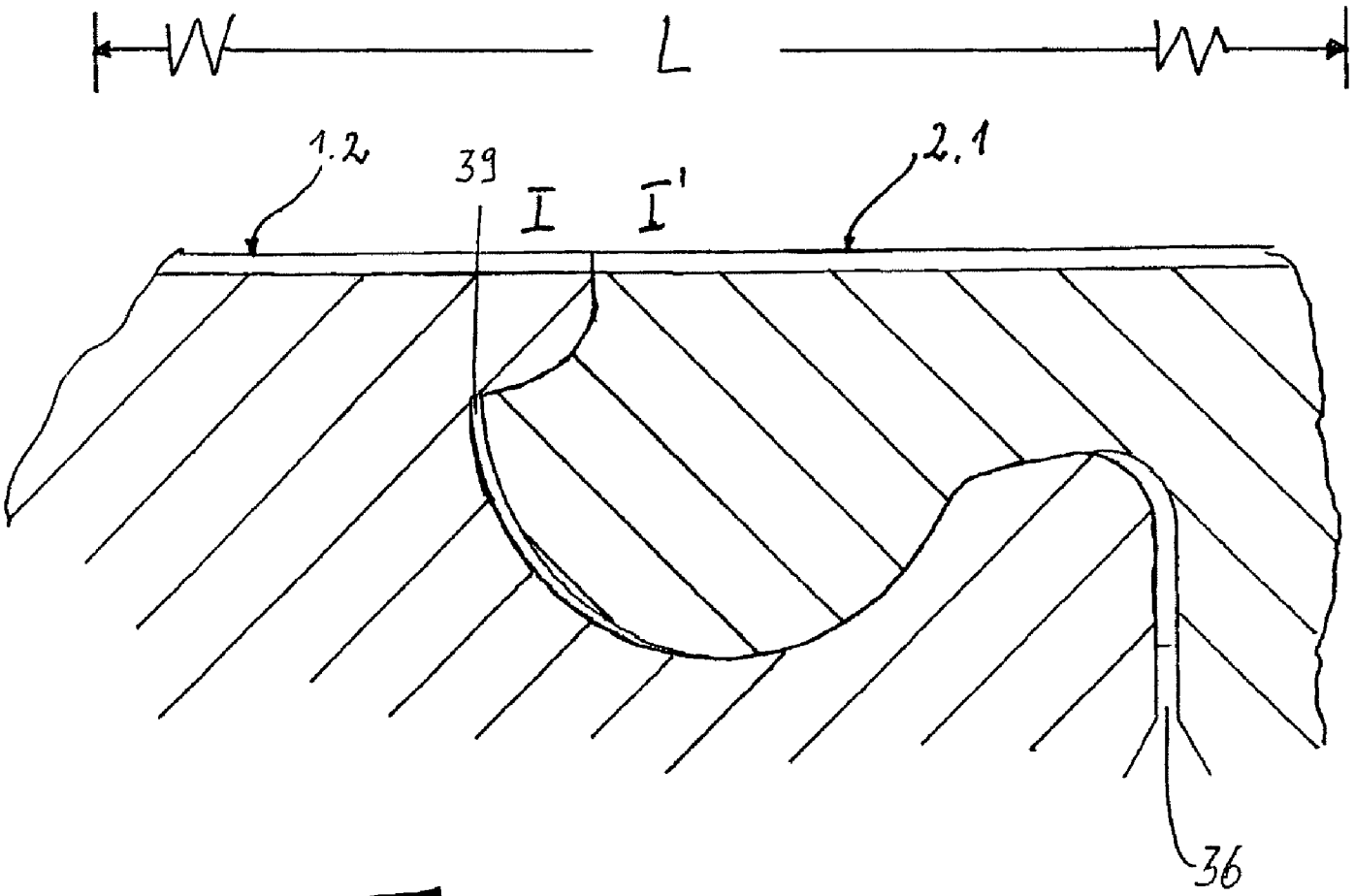
FIG. 10 shows a partial representation of two panels which are connected to one another on their longitudinal edges at the joining site.

The undercut 31, as shown in FIG. 10, causes locking in the transverse direction Q by positive locking with a corresponding shoulder 32 of the recess 29 being established. In the mounted state the tongue 30 engages an undercut which is formed by the upper lip 26 of the recess 29 so that the top 33 of the tongue 30 adjoins the bottom 40 of the upper lip 26 and locking takes place in the vertical direction V along the longitudinal edge I, I'. The shoulder 32 is made on the lower lip 33 of the recess 29 and terminates it, on the top of the shoulder 32 a tilted shoulder surface 35 being formed which is used as a support for the bearing region 28. The termination of the panel **1.*n* is formed by the essentially vertically running shoulder front 34 which passes via a rounding into the shoulder top 35**.

The shoulder top 35 on the longitudinal edge I and the bearing region 28 on the opposite longitudinal edge I' make available a relatively large support surface on which the two panels 1.2, 2.1 lie on one another in the joined state. The beveling by an angle μ causes a motion component to be produced in the transverse direction Q toward one another under vertical loading so that in the locked state for a force component acting from the top the gap between the two panels 1.2, 2.1 is reduced and the original locking can take place by inserting and pivoting the first panel into the second panel without pretensioning.

The shoulder 32 is made such that the shoulder top 34 does not have any contact with the vertical wall 27 for two interconnected panels 1.2, 2.1. Therefore there is a clearance 36 so that there is no unintended blocking action between the panels 1.2, 2.1 and motion toward one another can be effected when a force acting from the top is being delivered.

Between the tongue 30 and the top 18 of the panels **1.*n*, 2.*n*, an undercut 37 is formed which adjoins the edge which runs at a right angle to the top 18. The undercut 37 in the mounted state forms a clearance in which abraded particles or shavings from the production process which have not been removed can be accommodated. Likewise there is the corresponding execution of the round forward region of the tongue 30 so that the spring 10 in the mounted state likewise forms a gap 39** which can act as a dust pocket and motion space.

The panels **1.*n*, 2.*n*** are laid as follows:

To form a first row $R_1$, a first panel 1.1 is first placed on the subfloor. A second panel 1.2 with its transverse edge II is laid against the transverse edge II' of this panel 1.1, and as shown in FIG. 1, is either pivoted down onto the subfloor, or as shown for panel **1.*n*, is lowered in the vertical direction V, and this process is continued until the first row $R_1$ 1.1, 1.2, . . . 1.*n* has been completely put down. To form the second row $R_2$, another first panel 2.1 with its longitudinal edge I is first placed against the longitudinal edge I' of at least one, preferably two panels 1.1, 1.2 which have been put down in the first row $R_1$, and is joined and locked to these panels 1.1, 1.2 by pivoting down into the laying plane $E_v$. Another second panel 2.2 with its longitudinal edge I is placed against the longitudinal edge I' of at least one second panel (1.2, 1.3) which has been put down in the first row such that by pivoting down into the laying plane $E_v$ its longitudinal edge I is joined and locked to the longitudinal edge I' of the panel or panels 1.2, 1.3 which have already been put down in the first row $R_1$ and its transverse edge II is joined and locked to the transverse edge II' of the first panel 2.1 in the second row $R_2$. In this way as many panels 2.**$_i$ are joined and locked until the second row has been completely put down. To form the third and each subsequent row the aforementioned steps are repeated until the room is completely put down.

Figure 2:
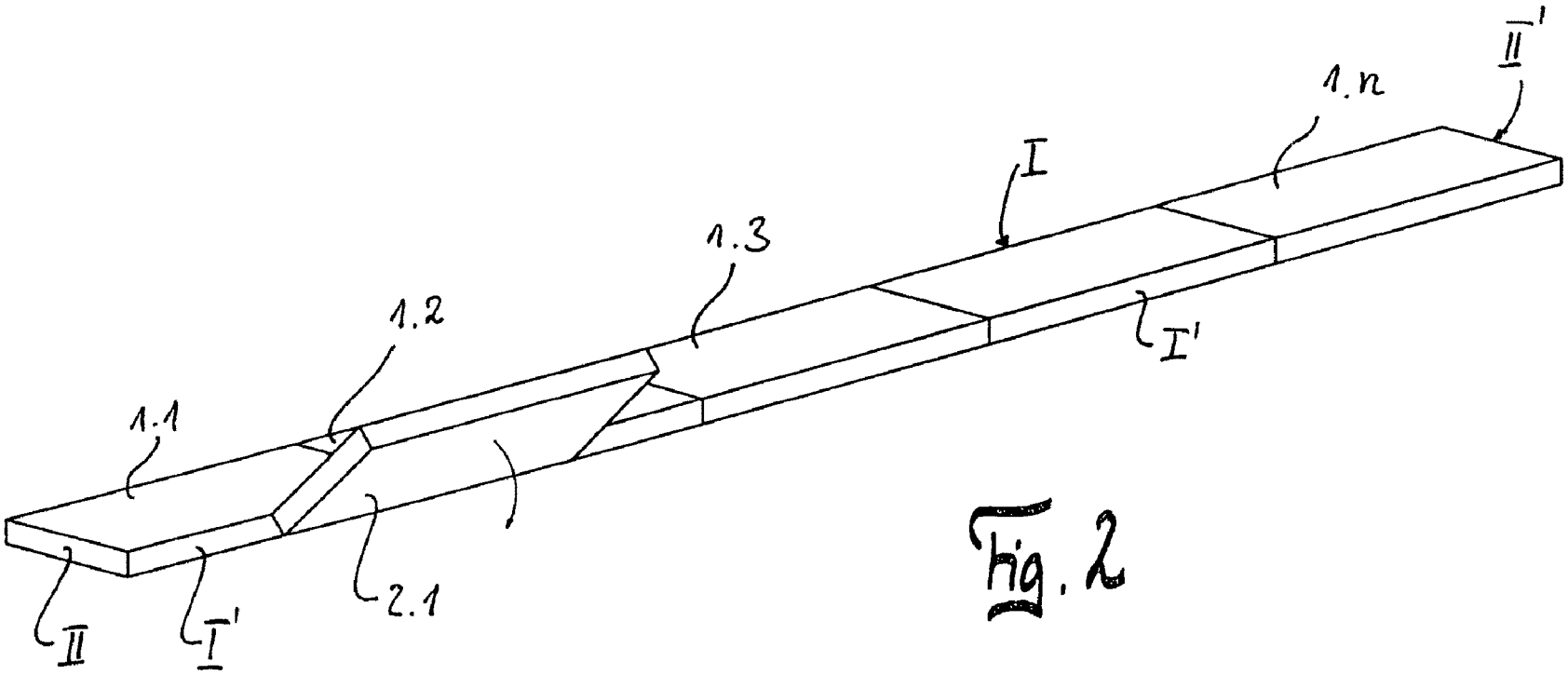
FIG. 2 shows a schematic of the formation of the second row $R_2$ of panels by another first panel.
Figure 3:
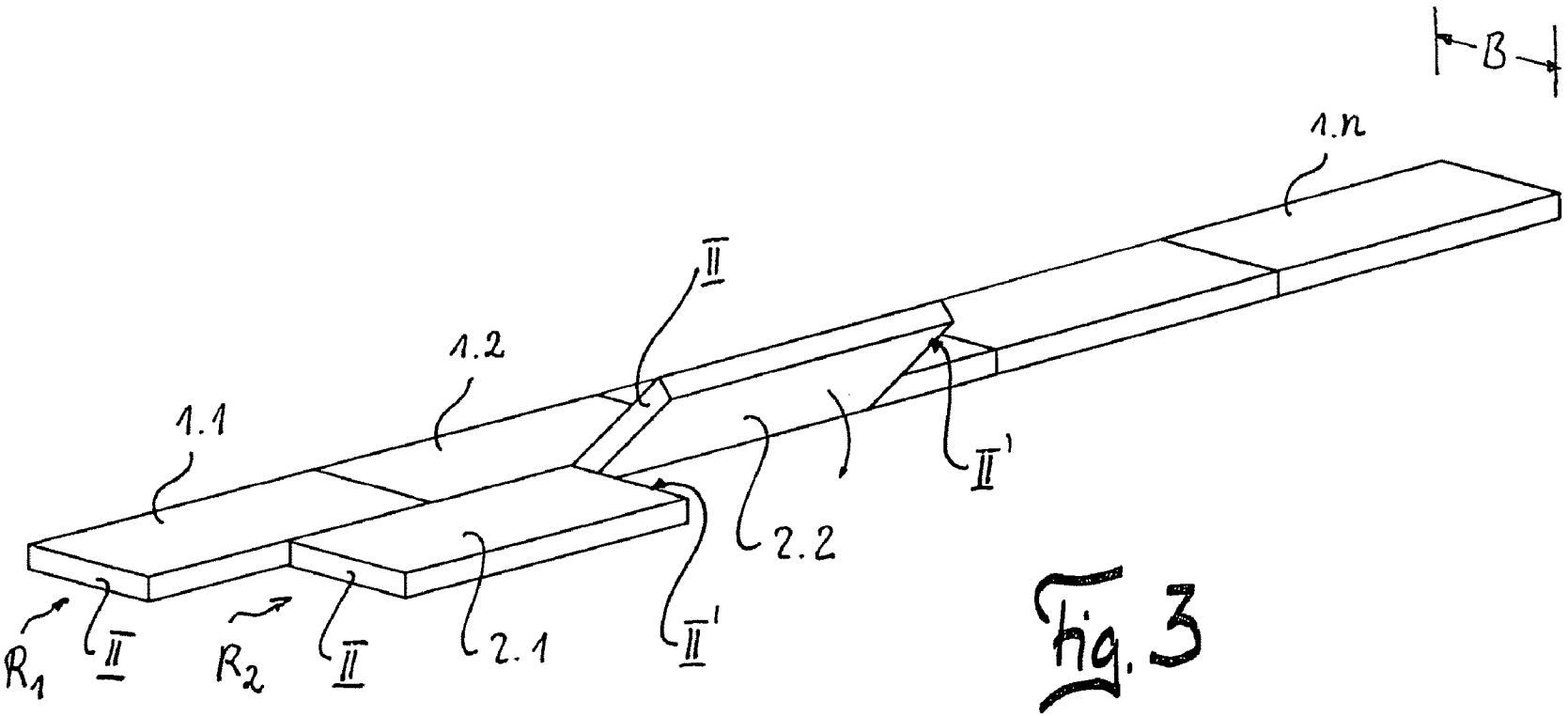
FIG. 3 shows a schematic of the continuation of the second row.

By the essentially vertical joint connection in the direction of the laying plane $E_v$, when the tongue element 3 with its lower edge **3*d* abuts the top 18 of the panel 1, the latter is pressed in the direction of the core 17 in the further joining motion as a result of its outer side edge 3*c* which runs at an angle $\alpha$ upon contact with the contact surface 16 so that it yields in the horizontal direction H. The panel 1.2 continues to be lowered. When the tongue element 3 reaches the location opposite the groove 9, as a result of the resetting force inherent in the material it is caused to rebound and snaps into the groove 9 where with its essentially horizontally running top 3*e* it adjoins the locking edge 4. At the same time the hook elements 20, 21 engage until the head surface 12 is supported on the support surface 13. The panels 1.1 and 1.2 are then joined and locked to one another on their transverse edges II, II'. The inner wall 10*a* of the slot 10 is used as a boundary of the deflection path for the tongue element 3 in order to prevent the connection of the tongue element 3 on its ends with the core 17 from pulling apart due to an excess plunging movement. The area, therefore the height and width, with which the ends of the tongue element are joined to the core 17, determine the spring rate of the tongue element 3. As FIG. 2 shows, three tongue elements 3 can be made over the length L of the side edge II and on the opposite side edge I three locking projections 22 can be formed. It is also quite conceivable to make the tongue elements 3 shorter and to provide five, six or even seven or more tongue elements 3 and corresponding locking projections 22**.

When the vertical slot 10 is made narrow enough, it is possible to keep the tongue element 3 joined to the core 17 only on one of its ends. This configuration has the advantage that the tongue element 3 can also expand in the direction of the width B of the side edge II. The then free end is then supported on the inner wall **10*a* of the slot 10**.

The tongue element 3 is machined out by means of tools which can be moved transversely to the working direction. Tools can be milling, laser or water jet tools and also vertical blades or broaches. For the two side edges II, II' only one movable tool at a time is necessary so that the releasing which is the other at the time can be made by means of one conventional, rigid tool. Here the region which has not been released and which joins the tongue element 3 to the core 17 in one piece is reduced.

In this way locking forces of differing strength can be set.

The locking can be released in all exemplary embodiments by the panels 1.1, 1.2, . . . being pushed relative to one another along the side edges II, II' or by an unlocking pin which is not shown being inserted laterally into the joining site.

The milling tools which are not detailed are submerged while the panel is being transported in its lengthwise direction. FIG. 8 shows the entrance **10*b* and exit 10*c* of the milling tool with which the vertical slot 10 is milled and the entrance 11*b* and exit 11*c* of the milling tool with which the horizontal slot 11 has been milled. The entrances 10*b*, 11*b* and exits 10*c*, 11*c* are arc-shaped, the radius depending on the advance speed of the panel 2**.

The panels **1.*n*, 2.*n* are conventionally provided on their top 18 with decoration which can be printed directly onto the top 18**. The decoration is conventionally covered by an antiwear layer into which structuring which corresponds to the decoration can be impressed.

The invention claimed is:

1. A method for laying of floor panels without adhesive which, on their opposite longitudinal edges (I, I') and transverse edges (II, II'), are provided each with profiling which corresponds to one another, in a space for forming a closed floor surface on a laying plane ($E_v$) in which several panels of the floor panels with their transverse edges (II, II') are joined and locked to one another into a row and with their longitudinal edges (I, I') into several rows ($R_n$), comprising:

a) to form a first row ($R_1$) of at least one panel:

$a_1$) a first panel is put down in the laying plane ($E_v$) and a second panel with its transverse edge (II') is placed against the transverse edge (II) of the first panel and by pivoting the second panel down or lowering it vertically into the laying plane ($E_v$) the first panel and the second panel are joined and locked to one another, and $a_2$) if the first row ($R_1$) is not complete, joining and locking to one another additional panels until the first row ($R_1$) is completed using the steps of $a_1$, b) to form a second row ($R_2$) of at least one additional panel:

$b_1$) another first panel with its longitudinal edge (I) is placed against a longitudinal edge (I') of the at least one panel which has been put down in the first row ($R_1$) and is joined and locked to the at least one panel by pivoting down into the laying plane ($E_v$), $b_2$) another second panel with its longitudinal edge is placed against the longitudinal edge (I') of the at least one panel which has been put down in the first row ($R_1$) such that by its being pivoted down into the laying plane ($E_v$) the longitudinal edge (I) of the another second panel is joined and locked to the longitudinal edge (I') of the at least one panel in the first row ($R_1$) and its transverse edge (II) is joined and locked to the transverse edge (II') of the another first panel in the second row ($R_2$), $b_3$) if the second row ($R_2$) is not complete, joining and locking to one another additional panels until the second row ($R_2$) is completed using the steps of $b_2$, c) to form a third ($R_3$) and each succeeding row ($R_i$) steps $b_1$) to $b_3$) are repeated until the space has been completely put down, wherein:

d) in the joining and locking of the transverse edges (II, II') a locking element of at least the at least one panel which comprises core material of the panels and which is integrally joined to it snaps into contact with a locking edge of an adjacent one of the at least one panel in a same row, and e) during locking by pivoting down or lowering of at least the at least one panel a force acts in a vertical direction (V) on the locking element and is converted at least partially into a force component which acts in a horizontal direction and effects a yielding movement and afterwards a snapping movement of the locking element directed oppositely, wherein the movement of the locking element both in the horizontal direction (H) and in the vertical direction (V) is ensured by releasing of the locking element relative to the core of the at least one panel.

2. The method as claimed in claim 1, wherein to release the locking element from the core there are at least one essentially horizontal slot and at least one essentially vertical slot.

3. The method as claimed in claim 1, wherein the locking element on at least one of its ends is joined to the core.

4. The method as claimed in claim 1, wherein there is at least one slot which proceeds from a bottom of the at least one panel to release the locking element.

5. The method as claimed in claim 4, wherein the at least one slot is formed at least partially through a lower locking section.

6. The method as claimed in claim 5, wherein the at least one slot is essentially vertical.

7. The method as claimed in claim 1, wherein the floor panels are comprised of a wood material.

8. The method as claimed in claim 7, wherein the floor panels are comprised of MDF or HDF.

9. A method of locking a plurality of panels, comprising:

locking at least a second panel in a first row to a previously laid panel on their transverse edges by placing the transverse edge of the at least second panel against the transverse edge of the previously laid panel and by pivoting the at least second panel down or lowering the at least second panel vertically into a laying plane; and continuing the locking step for additional panels until the first row is completed, wherein in the locking of the transverse edges at least one locking element which comprises a core material and which is integrally joined to each of the plurality of panels snaps into contact with a locking edge of the previously laid panel, and during locking by pivoting down or lowering into the laying plane a force acts in the vertical direction on the locking element of the at least second panel and is converted at least partially into a force component which acts in a horizontal direction and first of all a yielding movement and afterwards a snapping movement of the locking element directed oppositely are effected, wherein movement of the locking element both in the horizontal and vertical direction is ensured by releasing of the locking element relative to the core material of the panel.

10. The method as claimed in claim 9, wherein the locking element moves freely and forces have the locking element yield during the locking and then snapping back.

11. The method as claimed in claim 9, wherein when the panels are tilted, forces for lateral yielding motion do not rise, and the locking element yields to each force acting on it and springs back when the force is no longer acting.

12. The method as claimed in claim 9, further comprising during the locking, pretensioning is produced and vertical contact surfaces of the panels are pressed against one another so that a visible gap does not form on a top of two interconnected panels.

13. The method as claimed in claim 9, wherein during the locking a motion component is produced in a transverse direction toward one another under vertical loading so that in the locked state for a force component acting from a top a gap between the panels is reduced and the locking takes place by inserting and pivoting without pretensioning.

14. The method as claimed in claim 9, wherein during the locking, a shoulder top of one panel does not have any contact with a vertical wall of another panel of two interconnected panels thereby providing a clearance so that there is no unintended blocking action and motion toward one another can be effected when a force acting from the top is delivered.

15. The method as claimed in claim 9, further comprising forming a second row $R_2$ by placing at least one additional panel in a second row against a longitudinal edge of the previously laid panels in the first row $R_1$, and is joined and locked to the previously laid panels in the first row $R_1$ by pivoting down into the laying plane.

16. The method as claimed in claim 15, further comprising placing another second panel with its longitudinal edge against the longitudinal edge of at least one panel of the previously laid panels in the first row $R_1$ such that by its being pivoted down into the laying plane the longitudinal edge of the another second panel is joined and locked to the longitudinal edge of the at least one panel in the first row $R_1$ and its transverse edge is joined and locked to the transverse edge of the at least one additional panel in the second row $R_2$.

17. The method as claimed in claim 9, wherein when a tongue element with its lower edge abuts a top of the previously laid panel, the previously laid panel is pressed in the direction of the core material in the further joining motion as a result of its outer side edge which runs at an angle $\alpha$ upon contact with a contact surface so that it yields in a horizontal direction, and the second panel continues to be lowered.

18. The method as claimed in claim 17, wherein when the tongue element reaches a location opposite a groove, as a result of a resetting force inherent in the core material it is caused to rebound and snaps into the groove where with its essentially horizontally running top it adjoins a locking edge.

19. A method of locking a plurality of panels, comprising:

locking at least a second panel in a first row to a previously laid panel on their transverse edges by placing the transverse edge of the at least second panel against the transverse edge of the previously laid panel and by pivoting the at least second panel down or lowering the at least second panel vertically into a laying plane;

continuing the locking step for additional panels until the first row is completed, wherein in the locking of the transverse edges at least one locking element which comprises a core material and which is integrally joined to each of the plurality of panels snaps into contact with a locking edge of the previously laid panel, and during locking by pivoting down or lowering into the laying plane a force acts in the vertical direction on the locking element of the at least second panel and is converted at least partially into a force component which acts in a horizontal direction and first of all a yielding movement and afterwards a snapping movement of the locking element directed oppositely are effected; and releasing the locking element from the core material by having at least one essentially horizontal slot and at least one essentially vertical slot.

* * * * *